United States Patent [19]

Gershenson et al.

[11] Patent Number: 4,877,198

[45] Date of Patent: Oct. 31, 1989

[54] DEVICE FOR GROUNDING CONDUCTIVE FILM

[75] Inventors: Moshe Gershenson, Mohegan Lake, N.Y.; Mark L. Moskowitz, Wayne, N.J.

[73] Assignee: GAF Corporation, Wayne, N.J.

[21] Appl. No.: 228,133

[22] Filed: Aug. 3, 1988

[51] Int. Cl.[4] ..... B65H 75/28

[52] U.S. Cl. ..... 242/74; 242/55; 355/212

[58] Field of Search ..... 242/67.1 R, 67.3 R, 242/74, 197–200, 55; 355/3 BE, 16; 360/92, 93, 132

[56] References Cited

U.S. PATENT DOCUMENTS

| | | | |
|---|---|---|---|
| 2,339,652 | 1/1944 | Rockwood | 242/74 |
| 2,521,253 | 9/1950 | Quackenbush | 242/74 X |
| 2,732,146 | 1/1956 | Napolitani | 242/74 |
| 3,318,549 | 5/1967 | Macomber | 242/74 |
| 4,685,638 | 8/1987 | Satoyoshi et al. | 242/199 |

*Primary Examiner*—John M. Jillions

*Attorney, Agent, or Firm*—Jules E. Goldberg; Marilyn J. Maue; Joshua J. Ward

[57] ABSTRACT

A device for supplying a film which possesses an electrically conductive layer which can be grounded is described which is composed of a spool mountable on a rotatable grounded spindle; retaining means for securing the trailing edge of an electrically conductive film wound on the spool; means for electrically connecting the spool to the grounded spindle and contact means mounted on the trailing edge of the film so as to maintain electrical contact between the conductive layer of the film and the conductive means during unwinding of the film from the spool. The device allows the continuous unwinding of the spool while maintaining a simultaneous ground connection between the conductive layer of the spool and a ground.

13 Claims, 3 Drawing Sheets

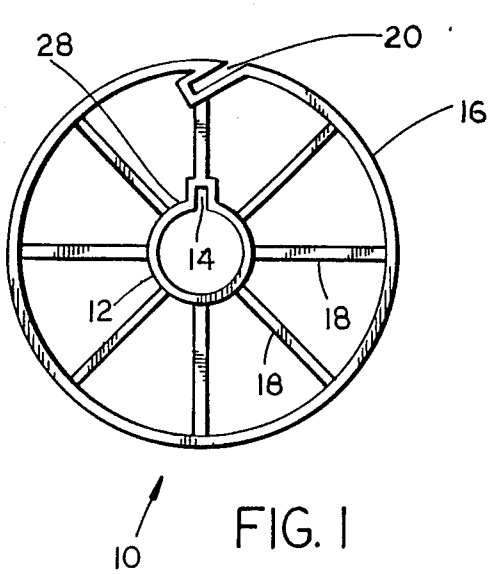
FIG. 1
FIG. 2
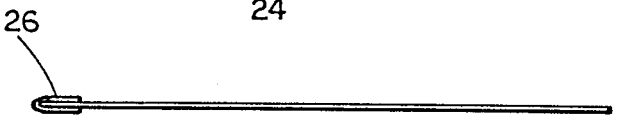
FIG. 3
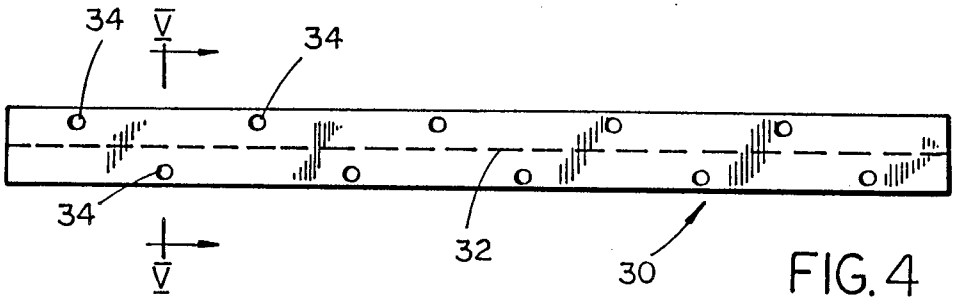
FIG. 4
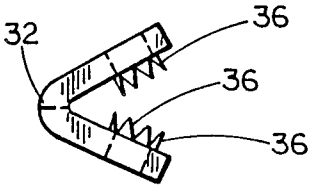
FIG. 6
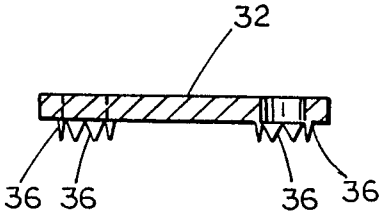
FIG. 5

DEVICE FOR GROUNDING CONDUCTIVE FILM

BACKGROUND OF THE INVENTION

1. Field of the Invention

This invention relates to the field of the simultaneous winding and grounding of electroconductive films. More particularly, it relates to photosensitive polyacetylenic systems wherein a film which is electroconductive is wound onto a spool with simultaneous grounding of the film.

2. Description of the Prior Art

Numerous systems are known wherein it is necessary to wind a film upon a spool and wherein the film must be grounded. Normally, such films are electroconductive.

This situation particularly arises in the area of photosensitive polyacetylenic systems. Such systems are disclosed in U.S. Pat. Nos. 4,066,676; 4,581,315; 3,501,310; 3,501,297; 3,501,303; 3,501,308; 3,772,028; 3,884,791; and 3,954,816.

Generally, a film composed of a variety of layers including a crystalline polyacetylene layer fed from a feed spool or reel, is exposed to a source of radiant energy. The radiant energy is directed against the film in a predetermined pattern resulting in an immediate image due to crystalline changes in the polyacetylenic compound. The film is then wound on a wind-up spool. After the desired pattern has been produced on a given length of film, this segment is cut from the film supply reel, and the freshly cut leading edge of the film on the supply spool is threaded through the exposure device and secured onto a take-up spool or reel.

Such films are composed of laminates of a variety of layers, one of which is a conductive layer. Usually, the conductive layer has a thickness in the range from about 1 angstrom to about 0.25 micrometers. The conductive layer limits the capacitance of the charge accepting layer which is normally the image-receptive polyacetylenic crystals which are dispersed in a binder in the film. It serves to dissipate excess and static charges which build up and which otherwise would produce significant defects in the resolution and clarity of the imaged pattern.

More specifically, the radiant energy, in the form of electrons possesses coulombic properties and are subject to deflection by an electrical field. It is thus possible for a considerable electric field to build up as a result of charge deposition on a non-conductive or non-grounded recording medium or film This build-up is sufficient to affect even the trajectory of 15–20 keV electrons. During exposure of a polyacetylenic imaging system using an electron beam recorder, focus problems in addition to image distortions up to 300 $\mu$m were observed. These phenomena were ascribed to a charge build-up in the media. Grounding of the conductive layer in the media in the polyacetylenic imaging system was shown to solve these problems.

In order to accomplish this, the conductive layer must be connected to a ground during the exposure process. Since the film is traversing past the exposure device during this treatment, the electrical contact with the conductive layer and the ground must be maintained during movement of the film. Typically, the conductive material is an electrically conductive metal, metal oxide, metal alloy, metal halide, or carbon black.

The conductive layer is normally an interior layer of the laminate, i.e., is not on the surface of the film.

Numerous attempts have been made to ground the film by contacting the conductive interlayer with a ground. However, it has proven difficult to simultaneously and continuously expose and wind-up the exposed film and layer.

Presently, grounding is achieved by using a complicated and rather expensive split metallic wind-up spool. In this spool, the leading edge of the film from the supply spool is locked between a set of sharp pins which penetrate through the film and then make contact with the conductive layer. Each time a piece of exposed film is cut from the end, the split spool must be opened and new conductive contact reestablished with the leading edge of the film from the supply spool. This increases the amount of handling and produces a costly interruption in the process. Thus, every time a piece of film is cut, increased cost is added to the process. Also, the contact obtained by this means is unreliable and, of course, the entire procedure is time-consuming.

SUMMARY OF THE INVENTION

We have discovered a device which allows the simultaneous and continuous grounding of an electroconductive film while the film is being processed and wound. With the present invention, the contact with the ground is easily maintained in a continuous manner. Moreover, the device of the present invention is relatively simple and does not require expensive or complicated machinery or electrical contact means.

More particularly, the present device comprises a spool which is adapted for mounting on a grounded rotatable spindle. When mounted, the spool will rotate with the spindle. The spool, which is to be used as a supply spool will have a given amount of film wrapped thereon. The trailing edge of the film is secured to the spool so a to allow initial winding of the supply film thereon. As used herein, the expression "leading edge" refers to that edge of the film which is taken from the supply roll first and proceeds through the process and is attached to the take-up spool. Conversely, the "trailing edge" of the film is that edge at the opposite end of the leading edge and is secured to the supply spool. The device further comprises retaining means for securing the trailing edge of an electrically conductive film to the spool in order to allow winding a supply amount of the film about the spool. The retaining means may be composed of a slot in the winding surface of the spool for insertion of the trailing edge of a film. The slot possesses a width which is minimally greater than the thickness of the edge of the film which is inserted. As used herein, the expression "minimally greater" means that the thickness of the slot opening is just slightly greater than the thickness of the edge of the film so that the interior of the slot will exert a grabbing effect on the film for starting of the winding. Of course, after one or two wraps of the film have wound about the surface, the film will be self-retaining due to its compression against itself.

The spool also possesses conductive means for electrically contacting the film in the slot with a spindle on which the spool is mounted. The spindle itself is normally grounded by virtue of its connection to a driving mechanism. In addition, the device comprises contact means on the trailing edge of the film for maintaining electrical contact with the conductive layer of the film and the spool conductive means during unwinding of the film on the spool.

With the present invention, the difficulties with the prior art split spool are completely overcome. Thus, since the present device allows for the conductive grounding of the feed supply spool rather than the rewind spool, cutting of the film after it has been treated with the electron beam recorder does not interrupt the contact. This saves a substantial amount of time since there is no interference with film cutting and the grounding is not interrupted every time a piece of film is cut.

BRIEF DESCRIPTION OF THE DRAWINGS

FIG. 1 is a cross-section of a spool in accordance with the present invention.

FIG. 2 is a cross-section of a strip for use on the trailing edge of the film in accordance with the present invention.

FIG. 3 depicts the trailing edge of a film having a strip thereon.

FIG. 4 is a top view of another embodiment of a strip in accordance with the present invention.

FIG. 5 is a cross-section of the strip of FIG. 4 along the line V—V.

FIG. 6 is a cross-section of the strip of FIG. 4 after bending.

DESCRIPTION OF THE PREFERRED EMBODIMENT

Figure 7:
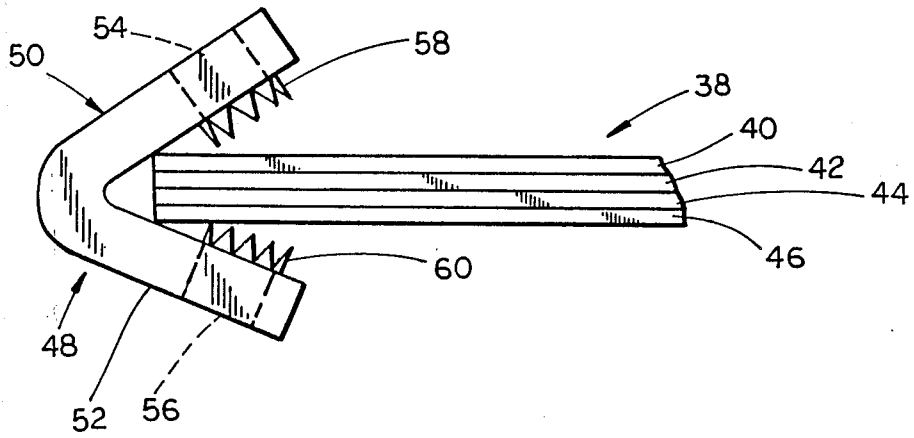
FIG. 7 is a cross-section depicting the placement of a film in a bent strip before crimping.

Referring to FIG. 1, a spool 10 is shown having a first inner cylindrical wall 12 defining a center hole 14 adapted for mounting on a rotatable spindle. Wall 12 has a key slot 28 therein to provide enhanced securement and/or electrical contact between the spool and spindle. Spool 10 further has a second outer wall 16 which is larger than wall 12 and coaxial therewith. Support members 18 which are in the form of radial spokes extending from the outer surface of wall 12 to the inner surface of wall 16 provide connecting means between the two walls. Outer wall 16 has a slot 20 therein. Slot 20 extends at an acute angle from the surface of wall 16 and has a generally rectangular shape. Of course, the spool may take any of a variety of conventional shapes and still be suitable for use in the inventive device.

FIG. 3 depicts a film 22 which is a conductive film. FIG. 2 depicts a cross-section of a metallic or conductive strip which is in the form of a V having arms 24. FIG. 3 depicts a conductive film 22 having crimped on the edge thereof a strip such as that depicted in FIG. 2.

The "U" or "V"-shaped strip is made from a conductive metal. Typically, this can be brass although other metals can be used. In one instance, brass shim stock, having a thickness of 0.010 inches, was used. The leading edge of the film is inserted into the slot formed by the V of the strip and the strip is then crimped thereon using high pressure, e.g., about 3,000 lbs. Generally, the strip has a length approximately the same as or less than the width of the film.

As a result of this high pressure, the brass strip penetrates through the film and assures contact with the conductive layer of the film to provide crimped end 26. It is this crimped end which is then inserted into slot 20 of spool 10 and upon winding, the film will adhere to the receiving surface 16 of the spool.

Slot 20 is minimally wider than the leading edge of the pressed brass strip on the film. This means that there is a tight fit as the crimped end 26 is inserted into slot 20 assuring good contact between the brass and the material of the spool. The spool can be made from any type of conductive material, such as metal, conductive plastic or a metallic-plated plastic. The spool will make contact with the spindle either by the tight fit about the spindle and/or through key slot 28. The spindle itself is grounded into the frame of the rotating device of which it is a part. As a result, continuity in the contact between the film, spool, and spindle is established resulting in discharging of all static charges. If desired, the strip could be plated with a corrosion resistant layer.

FIG. 4 depicts another embodiment of a metal strip 30 pursuant to the invention which is rectangular in shape and has a center score line 32 along which the strip ultimately will be bent into the V form. The strip has a plurality of holes 33 punched therein. Upon punching the holes, the exit side of the holes will have rugged edges or burrs 36. These are shown in FIG. 6, which depicts the strip of FIG. 5 after it has been bent into a V form with the protrusions or burrs 36 on the inner side of the V shape. Generally, for a film having a width of 5 inches, such a strip would normally be approximately 4–5 inches in length, approximately $\frac{1}{4}$ to $\frac{1}{2}$ inch in width and the burrs will extend from about 0.002 to 0.005 inches above the surface.

FIG. 7 shows a cross-section of an imaging media consisting of a multi-layered film 38. The film is composed of surface layer 40 which may be any type of transparent protective cover, an imaging layer 42 which usually contains the polyacetylenic compound, a conductive layer 44 and a base layer 46. This particular sequence of layers is merely for purposes of this description and does not necessarily depict an accurate cross-section of such an imageable film. Also, depending on the type of imaging desired, more or fewer layers may be present. However, FIG. 7 depicts a film wherein a conductive layer is sandwiched between at least two other layers, i.e., the conductive layer is not an outer layer of the film laminate. Strip 48 is bent in the form of a V having legs 50 and 52, each having holes 54 and 56 therein, respectively. Hole 54 has, on the interior portion of leg 50, protrusions or burrs 58 and hole 56 has protrusions 60.

Figure 8:
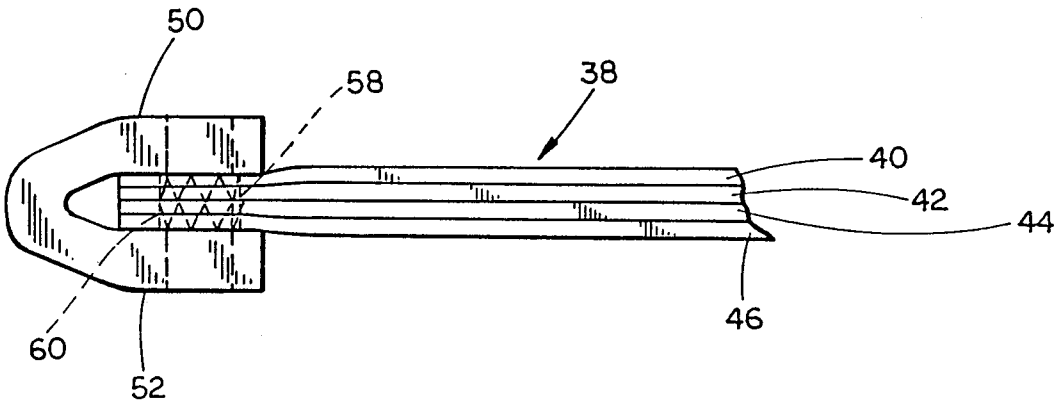
FIG. 8 is a cross-section depicting the placement of a film in a bent strip after crimping.

FIG. 8 shows the combination shown in FIG. 7 after crimping of the strip has taken place. As shown, legs 50 and 52 have been crimped together onto film 38, thus compressing layers 40, 42, 44, and 46 there between. Prongs or burrs 60 and 58 puncture through the various layers of film 38. As shown, prongs 60 enter into and are embedded in conductive layer 44, thus establishing electrical contact between conductive layer 44 and strip 50. Since there are a number of such holes and prongs on the lower leg 52, contact is made at a plurality of points thus assuring full contact of the conductive layer with strip 50. Moreover, the presence of holes and prongs on each leg of strip 50 insures that at least one set of prongs will enter into and be embedded in the conductive layer should the conductive layer, as depicted in FIG. 8, be towards one surface of the film as opposed to the other.

Figure 9:
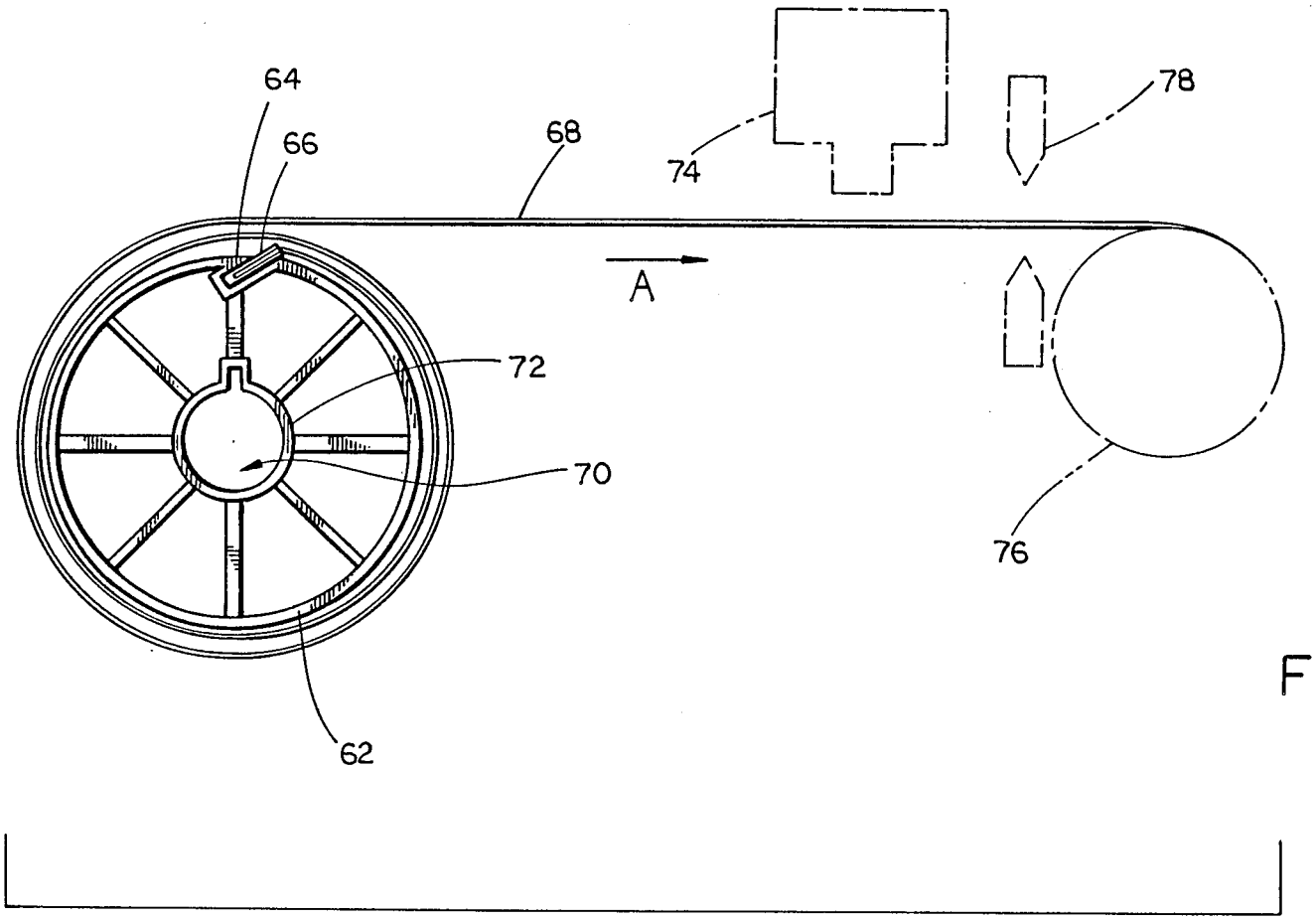
FIG. 9 is a schematic depicting a process using the inventive device.

FIG. 9 shows the device of the present invention wherein a film is wound several times about the spool. Thus, shown is spool 62 having slot 64 therein. Inserted into slot 64 is the trailing edge 66 of film 68, having the strip 50 crimped thereon. Not shown is the spindle which would be inserted into hole 70 and which through wall 72 would make electrical contact with the spool and thence to the film through crimped end 66.

FIG. 9 also schematically depicts a process in which the device of the present invention is used. In particular, film wound about spool 62 represents a supply of the film which travels in the direction indicated by arrow A. The film is passed under an exposure means 74 depicted diagrammatically at 74. Normally, this would include a means for producing ionizing radiation, such as an electron gun. The exposed film is then wound up onto rewind roll 76. Cutter 78 is spaced just in front of roll 76 so that the film can be cut at an appropriate point. However, since the electrical contact is made on supply roll 62, cutting of the film at this point, i.e., after exposure, does not break the electrical contact which is established on roll 62. Consequently, it is only necessary to re-start the cut end onto another rewind roll without the necessity of using a complicated device to reestablish electrical contact. As a result, with a device of the present invention, continuous electrical contact and grounding is achieved, resulting in significant savings in processing time and man-hours. In addition, the inventive device process provides improved uniformity in the final exposed product film. This is because once satisfactory grounding contact has been achieved, e.g., as determined at the beginning of the use of a new supply roll, this same degree of contact will be maintained throughout the entire lifetime of use of the particular supply roll. In contrast, with the prior art grounding device, each time the film is cut, a new grounding contact must be established which may or may not be satisfactory. Typically, for example, a supply roll will have approximately 200 feet of film on it. With the device of the present invention, that entire 200 feet of supply film is grounded. Exposure lengths of the film may vary anywhere from only a small length of film, e.g., 6 inches to 2 or 3 feet. Thus, after an initial exposure of the film, it will be immediately known whether or not the grounding contact on that supply roll is satisfactory. Once having been established as satisfactory, no further checking or the establishment of grounding contact is necessary With the prior art device, if, for example, an initial exposure of one foot of film from the 200 supply roll is made, the exposed portion is removed and new grounding contact is made with the leading edge. The possibility exists that the grounding contact made with the new leading edge is either unsatisfactory or different from that achieved for the first portion of exposed film. As can be understood, for a 200 foot length of supply film, literally hundreds of separate individual exposures may be made requiring the need to reestablish the grounding contact that many times. The possibility for non-uniformity and/or inadequacy of the reestablished grounding contact is thus multiplied man times.

What is claimed is:

1. A device for supplying a film having an electrically conductive layer comprising:
   (a) a spool adapted for mounting on a rotatable grounded spindle for rotation therewith;
   (b) retaining means for securing the trailing edge of an electrically conductive film wound on the spool;
   (c) conductive means for electrically connecting the spool to said grounded spindle; and
   (d) contact means mounted on the trailing edge of the film for maintaining electrical contact between the conductive layer of the film and the conducting means during unwinding of the film from the spool.

2. The device of claim 1 wherein the spool is formed from an electrically conductive material.

3. The device of claim 1 wherein the spool has a cylindrical member upon which the film is wound and wherein the retaining means is a slot in said member into which the trailing edge of the film is fitted.

4. The device of claim 3 wherein the slot has interior side walls forming a contact surface.

5. The device of claim 4 wherein the contact means is in electrical contact with said contact surface.

6. The device of claim 1 wherein the contact means comprises an electrically conductive strip conductively secured to the trailing edge of the film.

7. The device of claim 3 wherein the contact means comprises an electrically conductive strip conductively secured to the trailing edge of the film.

8. The device of claim 6 wherein the strip has a V shape defining a slot and the trailing edge of the film is sandwiched and secured within the slot by crimping.

9. The device of claim 7 wherein the strip has a V shape defining a slot and the trailing edge of the film is sandwiched and secured within the slot by crimping.

10. The device of claim 6 wherein he film is a laminate of at least three layers, one of the layers being conductive and said conductive layer being sandwiched between at least two non-conductive layers and wherein the strip has elements projecting therefrom which penetrate the film and make electrical contact with the conductive layer.

11. The device of claim 7 wherein the film is a laminate of at least three layers, one of the layers being conductive and said conductive layer being sandwiched between at least two non-conductive layers and wherein the strip has elements projecting therefrom which penetrate the film and make electrical contact with the conductive layer.

12. The device of claim 8 wherein the film is a laminate of at least three layers, one of the layers being conductive and said conductive layer being sandwiched between at least two non-conductive layers and wherein the strip has elements projecting therefrom which penetrate the film and make electrical contact with the conductive layer.

13. The device of claim 9 wherein the film is a laminate of at least three layers, one of the layers being conductive and said conductive layer being sandwiched between at least two non-conductive layers and wherein the strip has elements projecting therefrom which penetrate the film and make electrical contact with the conductive layer.

* * * * *